US005350974A

United States Patent [19]

Jacquot

[11] Patent Number: 5,350,974

[45] Date of Patent: Sep. 27, 1994

[54] COAXIAL ELECTROMAGNETIC WAVE INJECTION AND ELECTRON CYCLOTRON RESONANCE ION SOURCE

[75] Inventor: Bernard Jacquot, Novy-Chevrieres, France

[73] Assignee: Commissariat a l'Energie Atomique, Paris, France

[21] Appl. No.: 937,516

[22] Filed: Aug. 28, 1992

[30] Foreign Application Priority Data

Sep. 11, 1991 [FR] France ..... 91 11206

[51] Int. Cl.[5] ..... H01J 7/24

[52] U.S. Cl. ..... 315/111.81; 315/111.71; 313/359.1; 313/362.1

[58] Field of Search ..... 315/111.81, 111.71, 315/111.91; 313/359.1, 362.1

[56] References Cited

U.S. PATENT DOCUMENTS 4,631,438 12/1986 Jacquot ..... 315/111.81 X
4,780,642 10/1988 Jacquot ..... 315/111.81 X

FOREIGN PATENT DOCUMENTS 0238397 9/1987 European Pat. Off. .

OTHER PUBLICATIONS

Nuclear Instruments & Method In Physics Research; F. Bourg, R. Geller; "Source D' Ions Multicharges Minimafios: Nouvelles Caracteristiques"; vol. 196, No. 2/3, May 1982, Amsterdam, NL, pp. 325-329.

Nuclear Instruments & Methods In Physics Research; V. D. Dugar-Zhabon: "An ECR Source of Multiply Charged Ions Helios-12A"; vol. 219, No. 2, Jan. 1984; Amsterdam, NL, pp. 263-268.

*Primary Examiner*—Robert J. Pascal
*Assistant Examiner*—Haissa Philogene

[57] ABSTRACT

The present invention relates to an electron cyclotron resonance (ECR) ion source comprising an enclosure (1) containing an electron and ion plasma and a magnetic structure (11) surrounding the enclosure and that produces therein two radial and axial magnetic fields to ensure a confinement in the enclosure. A transition cavity (20) is connected to the enclosure by a first and a second ducts (21, 52) ensuring the transmission of said waves to the enclosure. The first duct is conductive and the second duct, located in the center of the first, is partly conductive and permits the introduction of a preionized gas into the enclosure. The enclosure and the second duct are connected to two power supply sources having the same polarity. The invention has applications in the field of particle accelerators.

8 Claims, 3 Drawing Sheets

COAXIAL ELECTROMAGNETIC WAVE INJECTION AND ELECTRON CYCLOTRON RESONANCE ION SOURCE

BACKGROUND OF THE INVENTION

1. Field of the Invention

The present invention relates to an improvement to an electron cyclotron resonance (ECR) ion source in particular permitting the production of multicharged ions.

It has numerous applications as a function of the different values of the kinetic energy of the ions produced, in the field of ion implantation, microetching and more particularly in particle accelerator equipment used both in the scientific and medical fields.

2. Description of the Related Art

In electron cyclotron resonance ion sources, the ions are obtained by the ionization in a sealed enclosure, such as a superhigh frequency cavity, of a gaseous medium constituted by one or more gases or metal vapours by means of electrons highly accelerated by electron cyclotron resonance. This resonance is obtained as a result of the combined action of a high frequency electromagnetic field injected into the enclosure containing the gas to be ionized and a magnetic field prevailing in the same enclosure and whose amplitude B satisfies the following ECR condition $B=F\cdot 2\pi m/e$, in which e represents the electron charge, m is mass and F the frequency of the electromagnetic field.

In these sources, the ion quantity which can be produced results from the competition between two processes, on the one hand the formation of ions by electron impact on neutral atoms constituting the gas to be ionized and on the other the destruction of the same ions by single or multiple recombination during a collision of the latter with a neutral atom. This neutral atom can come from a gas which has not yet been ionized or can be produced on the enclosure walls by the impact of an ion on said walls.

This disadvantage is obviated by confining, within the enclosure constituting the source, the ions formed, as well as the electrons used for their ionization. This is brought about by creating within the enclosure radial and axial magnetic waves defining a so-called "equimagnetic" surface, having no contact with the enclosure walls and on which the electron cyclotron resonance condition is satisfied. This surface is shaped like a rugby ball. The closer said equimagnetic surface is to the enclosure walls, the greater its efficiency, because it permits the limitation of the presence volume of neutral atoms and therefore the quantity of collisions between neutral atoms and ions. This surface also makes it possible to confine the ions and electrons produced by ionization of the gas. As a result of this confinement, the electrons created have the time to bombard several times the same ion and completely ionize it.

Such an ion source is described in the document filed on Mar. 13, 1989 in the name of the present Applicant and which was published under no. FR-A-2 595 868.

FIG. 1 diagrammatically shows a prior art ion source. Said source comprises an enclosure 1 constituting a resonant cavity which can be excited by a high frequency (HF) electromagnetic field. This electromagnetic field is produced by an electromagnetic wave generator 3 and is introduced into the enclosure 1 by means of a waveguide 5 and a transition cavity 20. This source also comprises an externally shielded magnetic structure 7, 9, 11, whose shield 11 makes it possible to only magnetize the volume in the enclosure 1 which is useful for ECR.

Apart from the shield 11, said magnetic structure also comprises permament magnet 7 and solenoids 9 arranged around the enclosure 1 and respectively creating a radial magnetic field and an axial magnetic field. These two magnetic fields are superimposed and distributed throughout the enclosure. Therefore they form a resultant magnetic field, which defines the resonant equimagnetic surface 13 within the enclosure 1.

A magnetic axis 15, which is also the longitudinal axis of the source, traverses the shield 11 via two openings 17 and 19 made in said shield 11 to respectively permit the extraction of ions from the enclosure 1, as well as the introduction of electromagnetic waves and gaseous or solid samples.

A first and a second ducts 21, 23 connect the opening 19 of the shield 11 to the respective openings 25 and 27 of the transition cavity 20, said openings being located on the side faces of the cavity 20, which is shaped like a cube.

The ratio of the diameters of these two ducts 21, 23 is such that it is possible to liken the latter to a coaxial line having a characteristic impedance of approximately 85 ohms. Such a coaxial line preferably propagates a transverse electromagnetic (TEM) mode, in which the electromagnetic field E is transverse to the propagation direction of the waves and perpendicular to the surface of the conductors, i.e. The ducts 21, 23.

In order to ionize a gas, the latter is introduced into the enclosure i by means of a gas duct 30 connected to the opening 27 of the transition cavity 20. The gas and the electromagnetic waves introduced into the cavity 20 are transmitted to the enclosure 1 by first and second ducts 21, 23, whose function is to make it possible to transmit said waves to said enclosure and inject them along the longitudinal axis 15.

It is also possible to create ions from a solid sample introduced in the form of a rod into the duct 23. However, throughout the following description, the ionization of a gas will be used as an example.

In the enclosure 1, the combination of the axial magnetic field and the electromagnetic field makes it possible to strongly ionize the gas introduced. The electrons produced are then highly accelerated by electron cyclotron resonance, which leads to the formation of a hot electron plasma confined in the volume defined by the equimagnetic surface 13.

The ions then formed in the enclosure I are extracted therefrom by an electric extraction field generated by a potential difference applied between an electrode 31 and the enclosure 1. The electrode 31 and the enclosure 1 are both connected to an electric power supply 33, the electrode 31 being positioned outside the opening 17 of the enclosure 1.

In order to check the intensity of the ion stream, it is possible to check the average power of the electromagnetic field by acting on a pulse generator 35, which is positioned upstream of a power supply 37 connected to the electromagnetic wave generator. The pulse generator 35 controls the said power supply 37 by adjusting the useful cycle, namely the ratio between the duration of a pulse and the period of the pulses.

Moreover, total pressure measuring means 39 are connected to an input of a comparator 41, whose output is connected to a valve 43 of the gas duct 30. To a second input of the comparator 41 is applied a reference voltage R and is compared with the measured value of the ion stream in order to give, at the comparator output, the value to be transmitted to the valve 43. This valve 43 makes it possible to act on the gas quantity to be introduced into the enclosure 1, so as to automatically regulate the ion stream.

Moreover, an adaptation piston 45 connected to a third lateral opening 29 of the cavity 20 makes it possible to regulate the internal volume of said cavity 20. The regulation of the piston 45 is used for tuning all the internal volumes of the cavity 20 to the frequency of the electromagnetic waves in order to obtain a minimum of reflected waves, i.e. waves returning to the wave generator 3. When these internal volumes are tuned to the frequency of the electromagnetic waves, the waves injected into the cavity 20 by the generator 3 are almost entirely transmitted by the ducts 21 and 23 to the plasma-containing enclosure I and are then absorbed by the equimagnetic surface 13.

In said prior art ion source, the second duct 23 is transparent to the electromagnetic waves at its end 23*a*, which is close to the opening 19 of the enclosure 1 positioned facing the shield 11.

In the internal volume of said transparent part 23*a* there is an axial magnetic field from the solenoids, an electromagnetic field and a high gas pressure. The electromagnetic field results from the electromagnetic waves transmitted between the first duct 21 and a non-transparent part 23*b* of the second duct 23 and which traverse the transparent part 23*a* of the second duct 23. Therefore, an electron cyclotron resonance can take place in the interior of the end 23*a* of the second duct 23 in a volume where there is a high gas pressure.

This end transparent to the electromagnetic waves consequently constitutes a self-regulated preionization stage, where the excess incident power of the electromagnetic waves is transmitted, without reflection, to the ECR zone constituted by the equimagnetic surface 13.

Thus, the more dense the plasma produced by electron cyclotron resonance (or preionized plasma) within the duct end 23*a*, the better the transmission of the electromagnetic waves, whereby said preionized plasma becomes conductive. More specifically, the preionized plasma is raised to a potential imposed on it by the immediate presence of the-conductive part 23*b* of the duct 23, which is itself exposed to the voltage of the power supply 33 via the duct 21 and the enclosure 1.

The plasma confined within the equimagnetic surface 13 is naturally raised to a positive potential compared with the enclosure 1. Thus, the electrons of said confined plasma are heated by cyclotron resonance of the electrons and certain of the latter which are of too high energy escape from the confinement. They will then strike against the enclosure 1 which, under this action, is negatively charged. Therefore the confined plasma has a more positive polarity than that of the enclosure.

In addition, the potential difference created between the enclosure 1 and the confined plasma is the cause of an electrical field E. The latter permits the transfer of confined ions to the opening 17 of the enclosure 1.

However, the preionization plasma extending up to the equimagnetic surface 13 is in contact with the confined plasma. However, said preionization plasma is conductive and is raised to the same potential as the enclosure 1. The electrical field E is then disturbed, which affects the capacities of the ion source.

The removal of the conductive part 23b of the second duct, whilst increasing the transparent part 23*a* would effectively permit the isolation of the preionization plasma from the confined plasma. However, in such an apparatus, the transmission of the electromagnetic wave from the generator 3 is no longer ensured, because said transparent part 23*a* is no longer conductive. However, the wave requires two coaxial conductors forming a coaxial transmission line in order to be transmitted.

SUMMARY OF THE INVENTION

The present invention makes it possible to optimize the electrical field E by isolating the preionization plasma from the confined plasma, whilst still ensuring the transmission of the electromagnetic wave. Thus, it proposes a central injection system for the preionization plasma electrically supplied by a voltage source.

More specifically, the present invention relates to a electron cyclotron resonance (ECR) ion source comprising:

- an enclosure containing a plasma of ions and electrons formed by electron cyclotron resonance,
- a magnetic structure surrounding the enclosure and creating, within the latter, two magnetic fields which are respectively radial and axial ensuring a confinement in the enclosure,
- a system for extracting the ions from the enclosure connected to an electric power supply,
- a transition cavity connected to an electromagnetic wave generator,
- a first conductive duct connecting in vacuum-tight manner the enclosure and the cavity and
- a second duct, which is at least partly conductive, axially traversing the first duct and the cavity and which issues into the enclosure.

This source is characterized in that the second duct, in which a resonance is produced at a resonance point, is connected to a second electric power supply.

According to the invention, the first and second electric power supplies are of the same polarity, so as to raise the enclosure and the second duct to different potentials compared with earth or ground.

Advantageously, the second duct comprises:

- a tube transparent to the electromagnetic waves made from a dielectric material,
- a conductive tube of limited thickness partly covering the transparent tube,
- a refractory metal tube of limited thickness placed against part of the inner face of the transparent tube.

According to the invention, the conductive tube covers the transparent tube from its part traversing the cavity up to a critical distance L: C/F from the resonance point C.

In the same way, the refractory metal tube covers that part of the inner face of the transparent tube from its part traversing the cavity to a critical distance L=C/F from the resonance point C.

According to an embodiment of the invention, the transparent tube is made from quartz, the conductive tube from copper and the refractory metal tube is formed from a tantalum sheet.

BRIEF DESCRIPTION OF THE DRAWINGS

The invention is described in greater detail hereinafter relative to non-limitative embodiments and with reference to the attached drawings, wherein show.

DETAILED DESCRIPTION OF THE PREFERRED EMBODIMENTS

Figure 1:
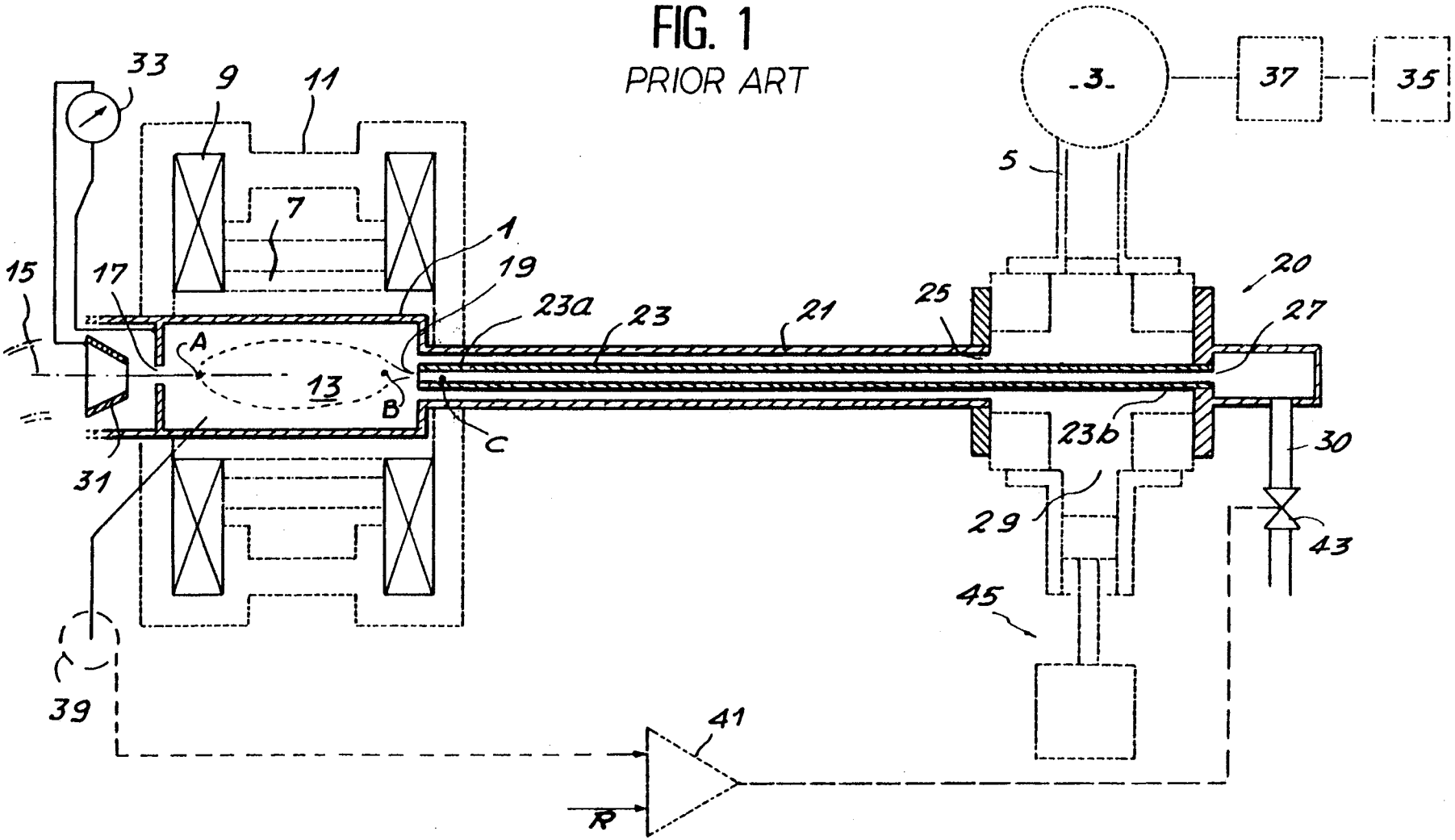
FIG. 1 PRIOR ART
FIG. 1 Already described, diagrammatically a prior art ECR ion source.

The references given and described in connection with the description of FIG. 1 are retained for the description of FIGS. 2 and 3, when the element involved is identical in the invention and in the prior art.

Figure 2:
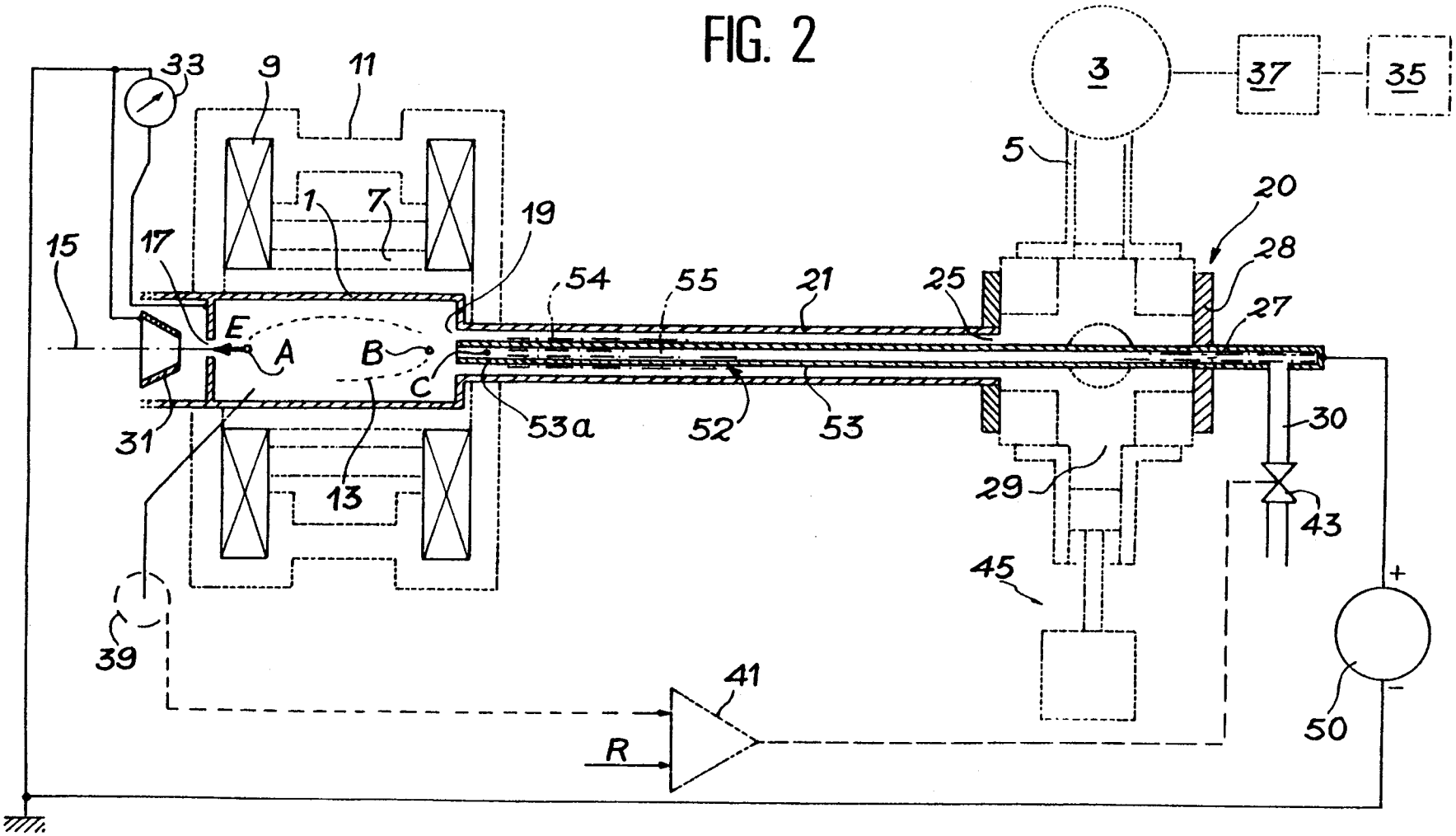
FIG. 2 Diagrammatically an ion source according to the invention.

FIG. 2 shows an ion source according to the invention. Thus, it shows the prior art ion source, as described hereinbefore, to which has been added a second electric power supply 50 and on which has been modified the second duct according to the invention. In FIG. 2, said duct carries the reference 52. The second power supply 50 is identical and of the same polarity as the first power supply 33. It permits the supply of a variable voltage substantially between 10 and 20 kV.

The power supply 50 is connected by its positive pole to the second duct 52 and by its negative pole to ground, as well as to the negative pole of the power supply 33.

The existence of the second power supply 50 makes it possible to raise the enclosure 1 and the duct 52 to potentials which are independent of one another and at identical polarities. Thus, when the enclosure 1 will be negatively charged on contact with the electrons which have escaped from the equimagnetic surface 13, the duct 52 will retain its positive polarity, in the same way as the preionization plasma which it contains. In addition, said preionization plasma, which has a polarity roughly similar to the polarity of the plasma confined in the equimagnetic surface 13, remains isolated with respect to the confined plasma.

In this way, the electrical field E between the confined plasma and the enclosure 1 and particularly the field E in front of the extraction orifice 17 is at an optimum.

FIG. 2 also shows the duct 52 according to the invention. This duct 52 has a quartz tube 53 positioned within the first duct 21 and which traverses the entire cavity 20 up to the opening of the gas duct 30.

This quartz tube 53 can, in more general terms, be a tube made from a transparent dielectric material. However, quartz has the advantage of not permitting degassing.

The duct 52 also comprises a very thin copper tube 54 threaded onto the quartz tube 53, i.e. surrounding the latter so as to conform to the outer surface of the quartz tube 53. The copper tube 54 is conductive and permits the transmission of the electromagnetic waves introduced into the duct 21. For a better transmission of said waves, the copper tube 54 is welded to the wall 28 of the cavity 20.

Moreover, to permit the preionization of the injected gas, the copper tube 54 does not completely cover the quartz tube 53. Thus, part 53a of the quartz tube 53 must remain transparent to the electromagnetic wave.

According to another embodiment of the duct 52, the copper tube 54 can be replaced by the metallization of the quartz tube 53, i.e. by a silvered deposit on said quartz tube.

The duct 52 also comprises a refractory metal tube 55 threaded within the quartz tube 53, i.e. placed against the inner wall of said quartz tube.

Advantageously and according to a preferred embodiment of the invention, the refractory metal tube 55 can be constituted by a thin tantalum sheet wound within the quartz tube 53 so as to conform to its internal surface in a quasi-perfect manner.

This refractory metal tube 55 can also be produced, using the same principle, by a tungsten film or sheet. This refractory metal tube 55 covers the inner surface of the quartz tube 53 over its entire length, except in the portion **53*a*** left transparent to the electromagnetic waves.

At the sealed end of the duct 52, i.e. at its end close to the gas duct 30, a .vacuum-tight passage is created in said duct 52 through which an electric wire ensures a connection between the power supply 50 and the refractory metal tube 55.

Figure 3:
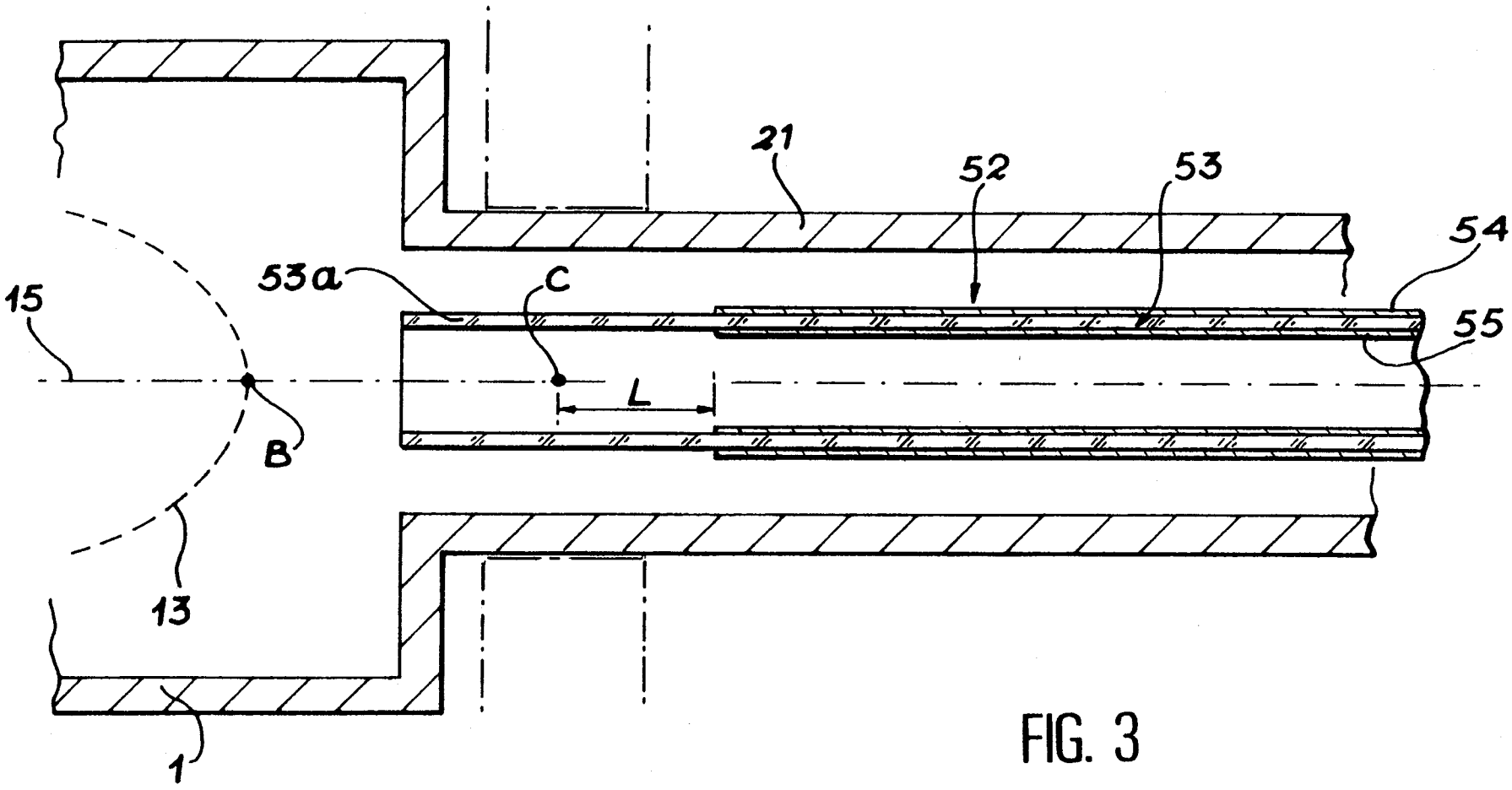
FIG. 3 On a larger scale the second duct in the vicinity of the resonance point C.

FIG. 3 shows the position of the tubes 53, 54, 55 as a function of the resonance point.

Thus, in an ion source with coaxial injection of the electromagnetic wave, such as the ion source described hereinbefore, the electrical fields (not shown in the drawings) of the electromagnetic waves are at an optimum at points A, B and C shown in FIG. 2. More specifically, the ECR is optimized at point C, when the electrical field reaches its maximum value, when it is perpendicular to the resonant induction field and located on a small radius cylinder, i.e. on the second, small radius duct 52.

Moreover, when said optimized ECR exists, the preionization plasma created in the duct 52 is so dense that it becomes virtually conductive, expanding up to the equimagnetic surface 13 and therefore reaching the point B. This equimagnetic surface 13 contains the confined plasma able to absorb and reflect the electromagnetic waves, thus making said surface 13 semiconducting from point B to point A.

Thus, from an electromagnetic standpoint, the ECR ion source behaves like a coaxial line up to point A of the magnetic axis 15. This open line is then the seat of standing waves between point A and the piston 45.

Therefore the position of the duct 52 relative to point C must be accurately defined. This position is represented in FIG. 3 by the critical distance L between the non-transparent portion of the duct 52 and the resonance point C.

The preionized plasma created at C not only diffuses up to point B, but also up to the metal tube 55, which is conductive. Therefore the metal tube 55 can be interrupted at a distance L from point C, said critical distance L being determined on the basis of the equation $L=C/F$, in which C is the speed of light and F the frequency of the electromagnetic wave. According to an embodiment and for a frequency F of 10,120 MHz, the distance L between point C and the tube 55 is 2.96 cm.

From an electromagnetic standpoint, the electromagnetic wave transmission takes place as if the preionization plasma also extended the copper tube 54. The standing wave system between point A and the piston 45 (FIG. 2) is consequently not disturbed. Moreover, the electromagnetic wave from the generator 3 is transmitted to the plasma up to point A, where it is reflected to the piston 45, which returns it into the plasma and so on, until the wave is totally absorbed by the plasma in the electron cyclotron process.

Thus, the positive polarization of the duct 52 by a power supply 50 makes it possible to isolate the preionized plasma in said duct and the plasma confined in the equimagnetic surface 13 so as to bring about the optimum establishment of the electrical field E for the extraction of the ions without disturbing the transmission of the electromagnetic waves necessary for the ECR phenomenon.

The described apparatus makes it possible to increase the performance characteristics of a known ion source (like that shown in FIG. 1) by a factor of 3 to 4.

I claim:

1. Electron cyclotron resonance (ECR) ion source comprising:

an enclosure (1) containing a plasma of ions and electrons formed by electron cyclotron resonance, a magnetic structure (11) surrounding the enclosure and creating, within the latter, two magnetic fields which are respectively radial and axial ensuring a confinement in the enclosure, a system for extracting the ions from the enclosure connected to an electric power supply (33), a transition cavity (20) connected to an electromagentic wave generator (3), a first conductive duct (21) connecting in vacuum-tight manner the enclosure and the cavity and a second duct (52), which is at least partly conductive, axially traversing the first duct and the cavity and which issues into the enclosure, characterized in that the second duct, in which a resonance is produced at a resonance point C, is connected to a second electric power supply (50).

2. Ion source according to claim 1, characterized in that the first and second power supplies are of the same polarity, so as to raise the enclosure and the second duct to the different potentials compared with ground.

3. Ion source according to claim 1, characterized in that the second duct comprises:

a tube transparent (53) to the electromagnetic waves made from a dielectric material, a conductive tube (54) of limited thickness partly covering the transparent tube, a refractory metal tube (55) of limited thickness placed against part of the inner face of the transparent tube.

4. Ion source according to claim 3, characterized in that the conductive tube covers the transparent tube from its part traversing the cavity up to a critical distance $L=C/F$ from the resonance point C.

5. Ion source according to claim 3, characterized in that the refractory metal tube covers that part of the inner surface of the transparent tube from its portion traversing the cavity up to a critical distance $L=C/F$ from the resonance point C.

6. Ion source according to claim 3, characterized in that the transparent tube is a quartz tube.

7. Ion source according to claim 3, characterized in that the conductive tube is made from copper.

8. Ion source according to claim 3, characterized in that the refractory metal tube is formed by a tantalum sheet.

* * * * *